US009565980B2

(12) United States Patent
Welch

(10) Patent No.: US 9,565,980 B2
(45) Date of Patent: Feb. 14, 2017

(54) AIR DIVERSION DEVICES, SYSTEMS, AND METHODS

(71) Applicant: Casey B. Welch, DPO, AA (US)

(72) Inventor: Casey B. Welch, DPO, AA (US)

( * ) Notice: Subject to any disclaimer, the term of this patent is extended or adjusted under 35 U.S.C. 154(b) by 23 days.

(21) Appl. No.: 14/742,020

(22) Filed: Jun. 17, 2015

(65) Prior Publication Data

US 2016/0367089 A1 Dec. 22, 2016

(51) Int. Cl.
*F26B 25/18* (2006.01)
*A47K 10/48* (2006.01)
*F26B 21/00* (2006.01)

(52) U.S. Cl.
CPC ..... *A47K 10/48* (2013.01); *F26B 21/004* (2013.01)

(58) Field of Classification Search
CPC ..... F26B 5/00; F26B 11/00; F26B 19/00; F26B 25/00; F26B 25/18; A47K 10/00; A47K 10/1048
USPC .... 34/90, 104, 105, 227, 239; 392/381, 384, 392/385; 4/678, 638
See application file for complete search history.

(56) References Cited

U.S. PATENT DOCUMENTS 3,744,149 A * 7/1973 Helbling ..... A47K 10/48 34/202
4,195,416 A * 4/1980 Hall ..... A47K 10/48 34/233
4,802,287 A * 2/1989 Chen ..... A47K 10/48 219/242
4,937,432 A * 6/1990 Bertani ..... A47K 10/48 200/52 R
5,107,603 A * 4/1992 Durazzani ..... D06F 58/20 34/604
5,279,048 A * 1/1994 Lawall ..... A45D 20/12 34/90
5,404,419 A * 4/1995 Artis, Jr. ..... A47K 10/48 34/239
5,438,763 A * 8/1995 Yang ..... A47K 10/48 34/619
5,568,691 A * 10/1996 Rubin ..... A45D 20/16 34/98
5,640,781 A * 6/1997 Carson ..... A45D 20/16 132/229
5,761,825 A * 6/1998 Ammon ..... A45D 20/12 34/90
6,038,786 A * 3/2000 Aisenberg ..... A47K 10/48 34/202
6,189,230 B1 * 2/2001 Huen ..... A47K 10/06 34/210
7,774,953 B1 * 8/2010 Duran ..... A47K 10/48 239/54

(Continued)

FOREIGN PATENT DOCUMENTS

GB 2497871 A * 6/2013 ..... A47K 10/48

*Primary Examiner* — Stephen M Gravini
(74) *Attorney, Agent, or Firm* — Snell & Wilmer L.L.P.

(57) ABSTRACT

In an example embodiment, an air diversion device comprises a cover adaptable to be coupled to a wall-mounted hand dryer, the cover at least partially surrounding an inner volume, a first aperture disposed in the cover and adaptable to bring a hand dryer output of the wall-mounted hand dryer into fluid communication with the inner volume, and a wand coupled to the cover and in fluid communication with the inner volume, wherein the wand comprises a flexible tube and a wand aperture disposed distal to the flexible tube and the cover.

5 Claims, 7 Drawing Sheets

(56) References Cited

U.S. PATENT DOCUMENTS

Figure 1:
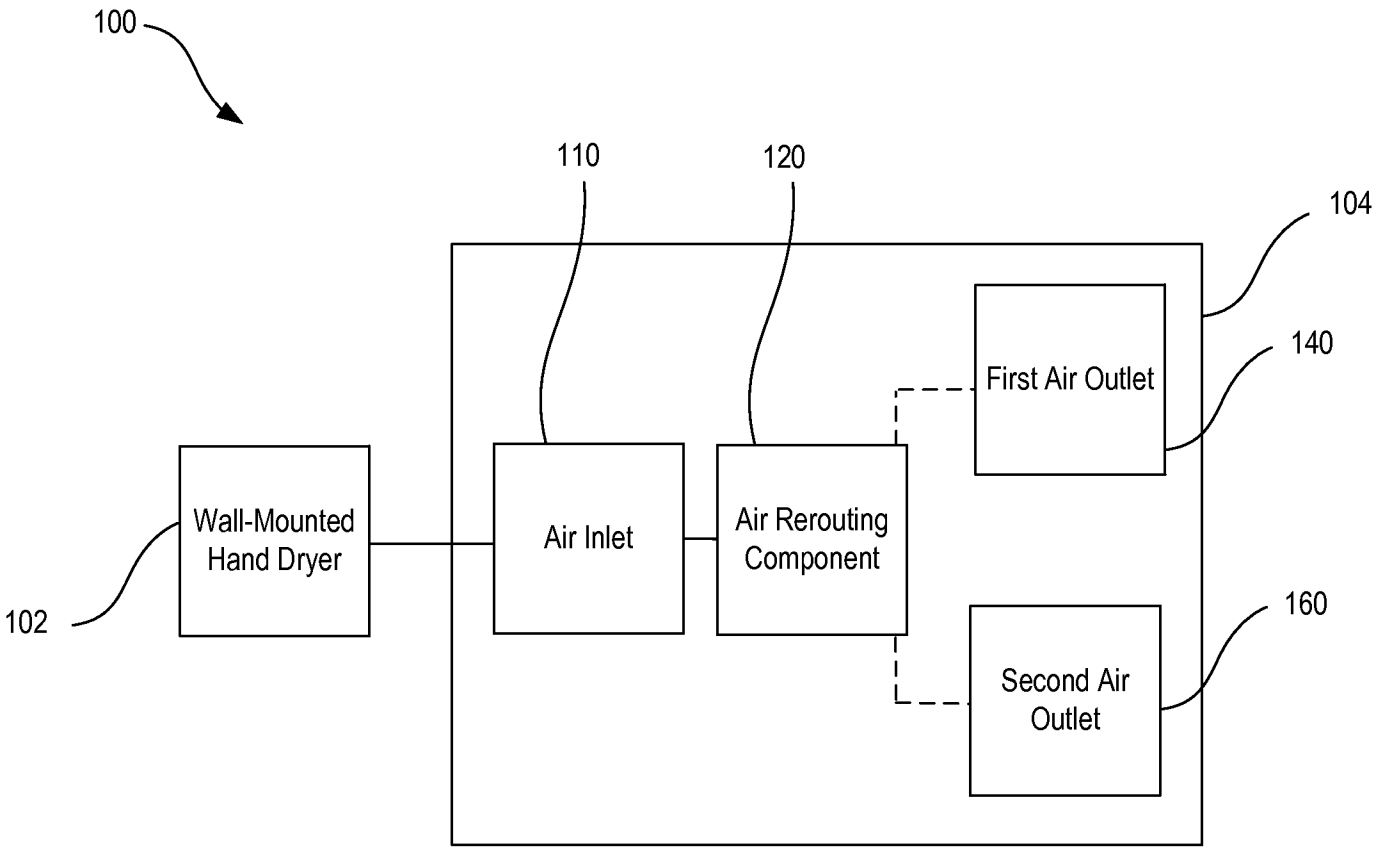

| | | | | |
|---|---|---|---|---|
| 7,971,368 | B2 * | 7/2011 | Fukaya | A47K 10/48 222/1 |
| 8,136,262 | B2 * | 3/2012 | Collins | A47K 10/48 34/105 |
| 8,201,344 | B2 * | 6/2012 | Sawabe | A47K 10/48 132/73.5 |
| 8,347,522 | B2 * | 1/2013 | Dyson | A47K 10/48 34/104 |
| 8,607,472 | B2 * | 12/2013 | Ishii | A47K 10/48 15/97.1 |
| 8,813,383 | B2 * | 8/2014 | Liu | A47K 10/48 15/97.1 |
| 9,220,381 | B2 * | 12/2015 | Akiyoshi | A47K 10/48 |
| 9,220,382 | B2 * | 12/2015 | Liu | A47K 10/48 |
| 2008/0052952 | A1 * | 3/2008 | Nelson | A47K 10/48 34/554 |
| 2012/0246963 | A1 * | 10/2012 | Fisher | A47K 10/48 34/241 |
| 2012/0324755 | A1 * | 12/2012 | Zhao | A45D 20/12 34/427 |
| 2015/0135429 | A1 * | 5/2015 | Dyson | A47K 10/48 4/678 |
| 2016/0045084 | A1 * | 2/2016 | Shabazz | A45D 20/08 392/380 |

* cited by examiner

AIR DIVERSION DEVICES, SYSTEMS, AND METHODS

FIELD

This disclosure relates generally to attachments for wall-mounted hand dryers. More specifically, this disclosure relates to air diversion devices and systems and methods for retrofitting wall-mounted hand dryers with the same.

BACKGROUND

Wall-mounted hand dryers typically comprise a single air output that is actuated by a button, sensor, or the like. Actuation typically causes heated air to be forced from the air output for a short duration. However, the drying efficacy of such hand dryers decreases if the user's hands are not in close proximity to the air output. Moreover, such hand dryers are often mounted at a vertical distance from the ground suitable only for adults of average height. As a result, wall-mounted hand dryers are less effective for certain individuals, such as children or wheelchair users, and for non-conventional uses, such as drying objects other than a user's hands.

SUMMARY

In an example embodiment, an air diversion device comprises a cover adaptable to be coupled to a wall-mounted hand dryer, the cover at least partially surrounding an inner volume, a first aperture disposed in the cover and adaptable to bring a hand dryer output of the wall-mounted hand dryer into fluid communication with the inner volume, and a wand coupled to the cover and in fluid communication with the inner volume.

In another example embodiment, a system for forced air drying comprises a wall-mounted hand dryer having a hand dryer output and an air diversion device, the air diversion device comprising an air inlet, a first air outlet, a second air outlet, and an air rerouting component for switching between a first state and a second state. In such an embodiment, the first state consists of a first fluid connection between the air inlet and the first air outlet, the second state consists of a second fluid connection between the air inlet and the second air outlet, the air diversion device is attached to the wall-mounted hand dryer so as to receive air from the hand dryer output, and the first air outlet is coupled to a wand.

In another example embodiment, a method comprises retrofitting an air diversion device to a wall-mounted hand dryer and using the same.

BRIEF DESCRIPTION OF THE DRAWING FIGURES

Figure 2A:
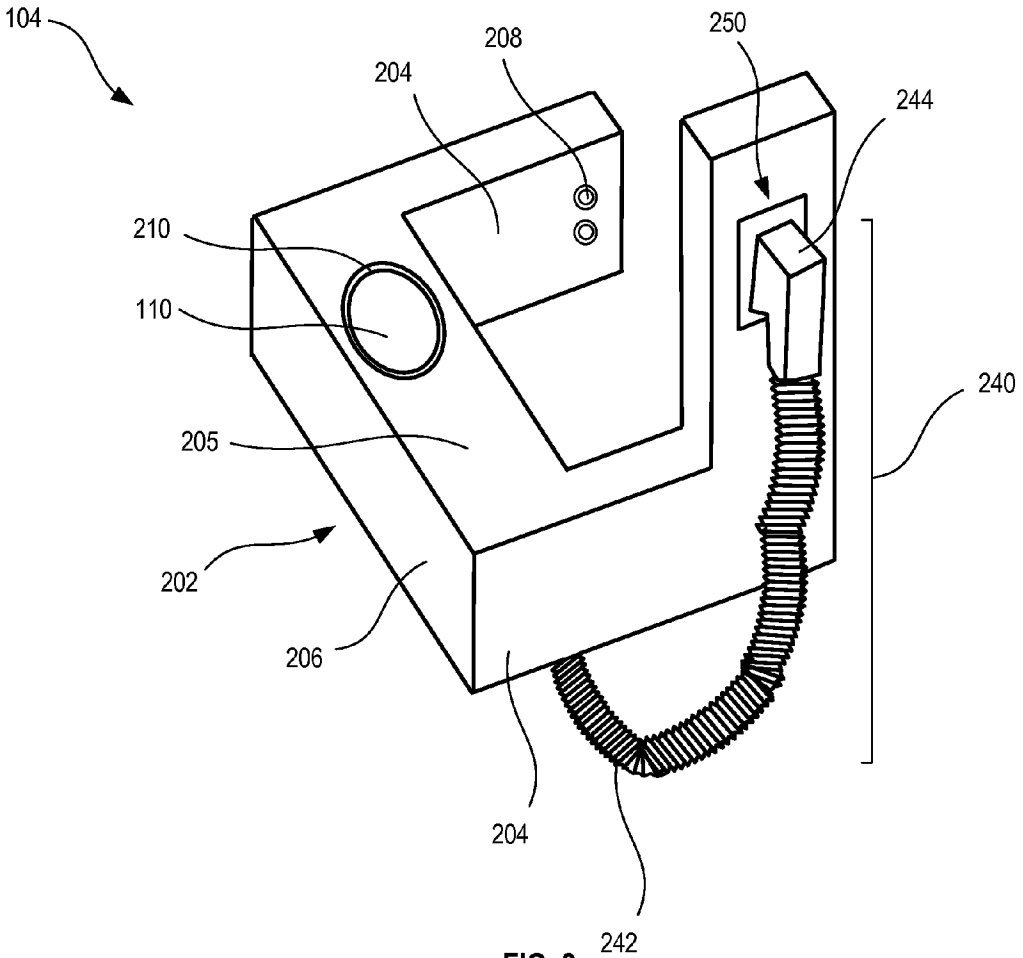
Figure 2B:
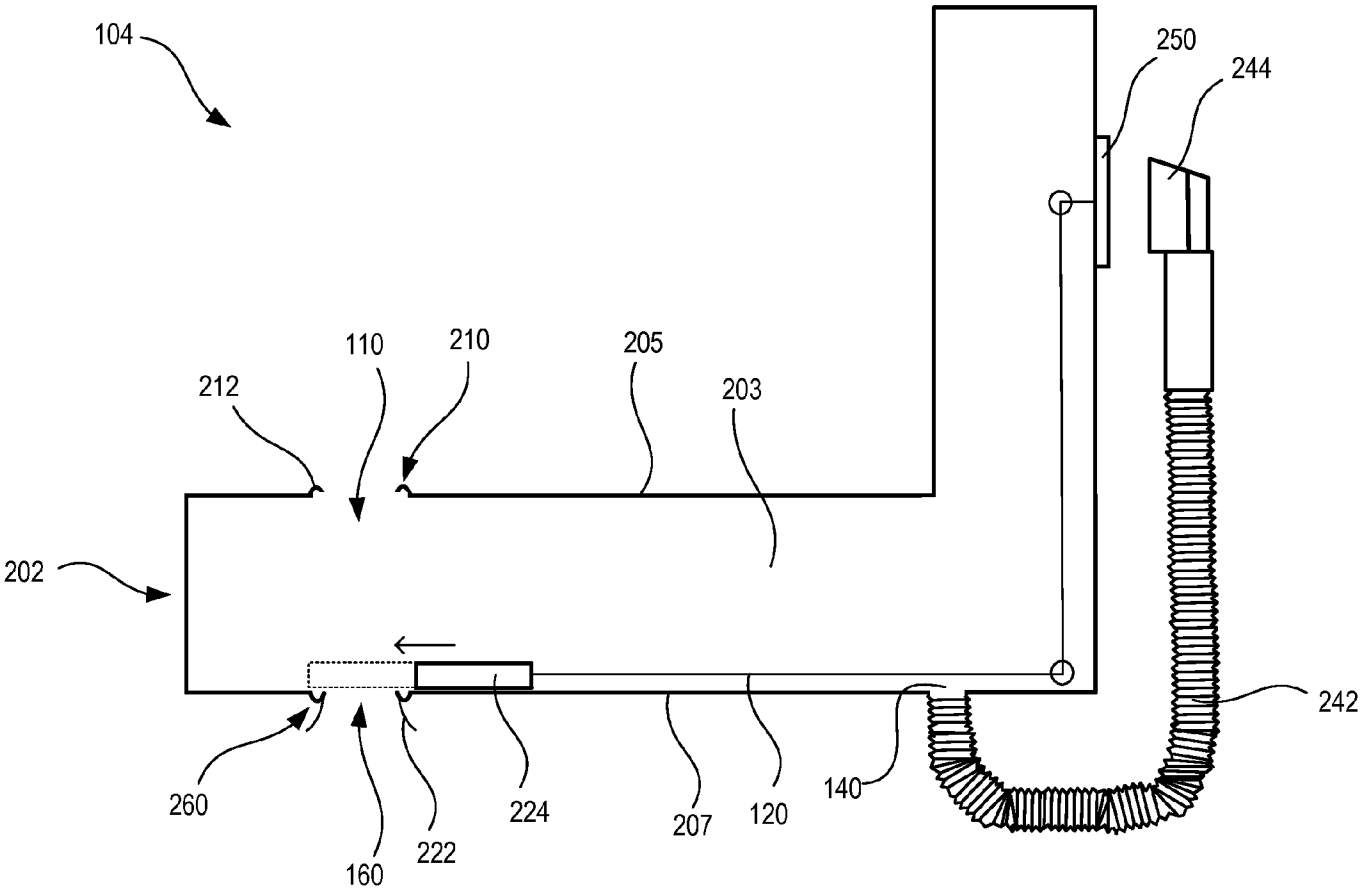

A more complete understanding of this disclosure may be derived by referring to the detailed description and claims when considered in connection with the drawing figures, wherein like reference numbers refer to similar elements throughout the drawing figures, and:

FIG. 1 is a block diagram of an example system for forced air drying;

FIG. 2*a* illustrates a perspective view of an example air diversion device;

FIG. 2*b* illustrates a cross-sectional view of the example forced air drying system in FIG. 2*a*.

Figure 3B:
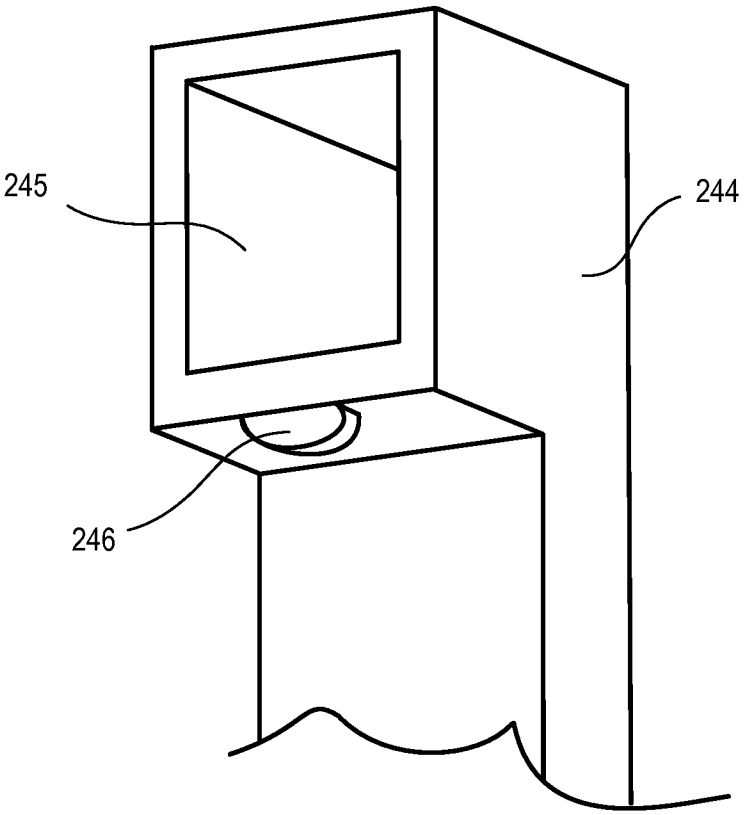
Figure 3A:
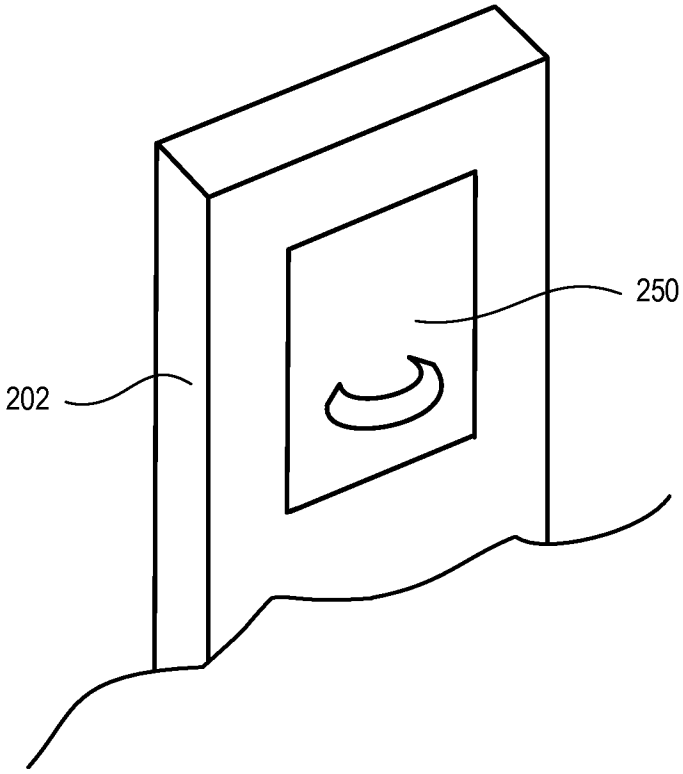

FIG. 3*a* illustrates a perspective view of a nozzle hanger of the example air diversion device of FIG. 2*a;*

FIG. 3*b* illustrates a perspective view of a nozzle portion of the example air diversion device of FIG. 2*a;*

Figure 4B:
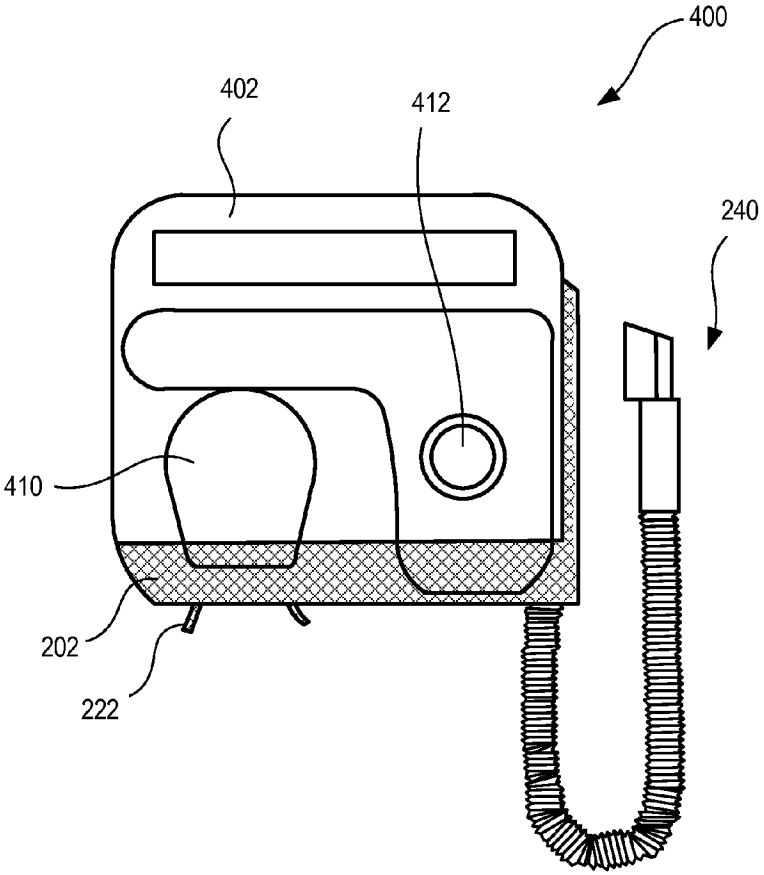
Figure 4A:
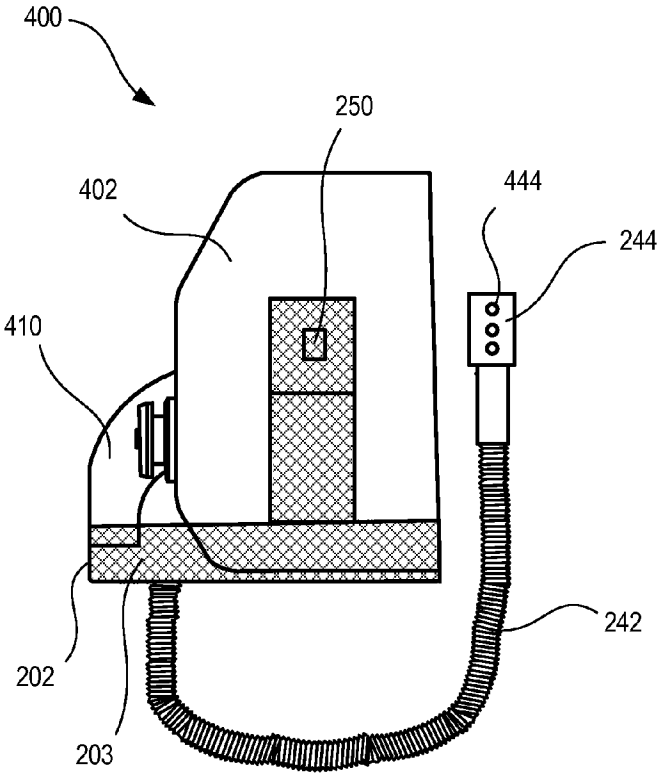

FIG. 4*a* illustrates a side view of an example forced air drying system;

FIG. 4*b* illustrates a front view of the example forced air drying system of FIG. 4*a;*

Figure 4C:
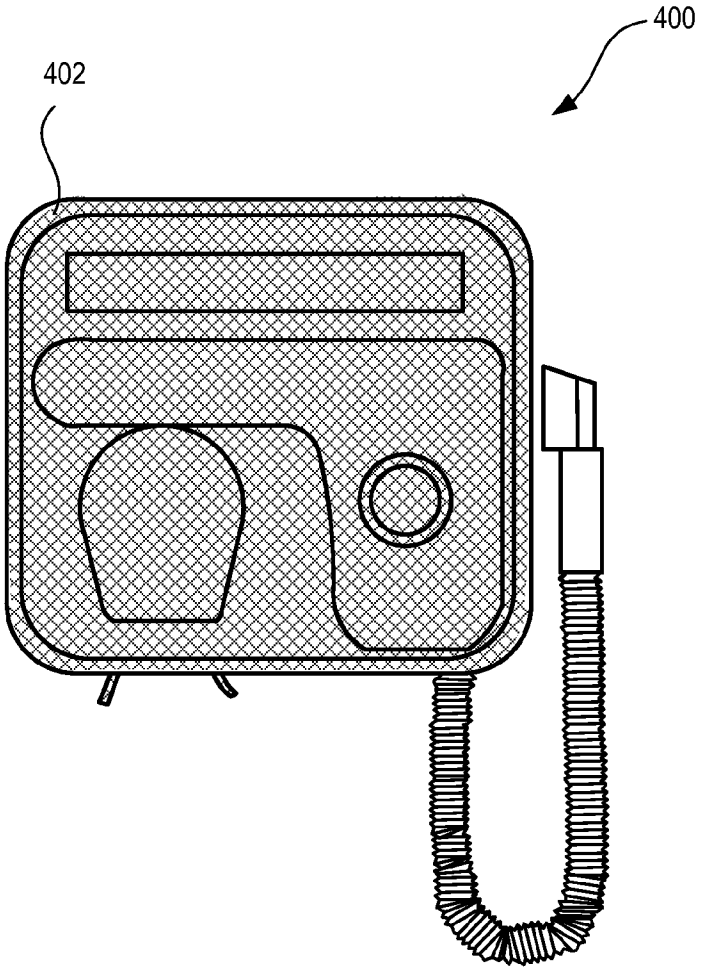
Figure 5:
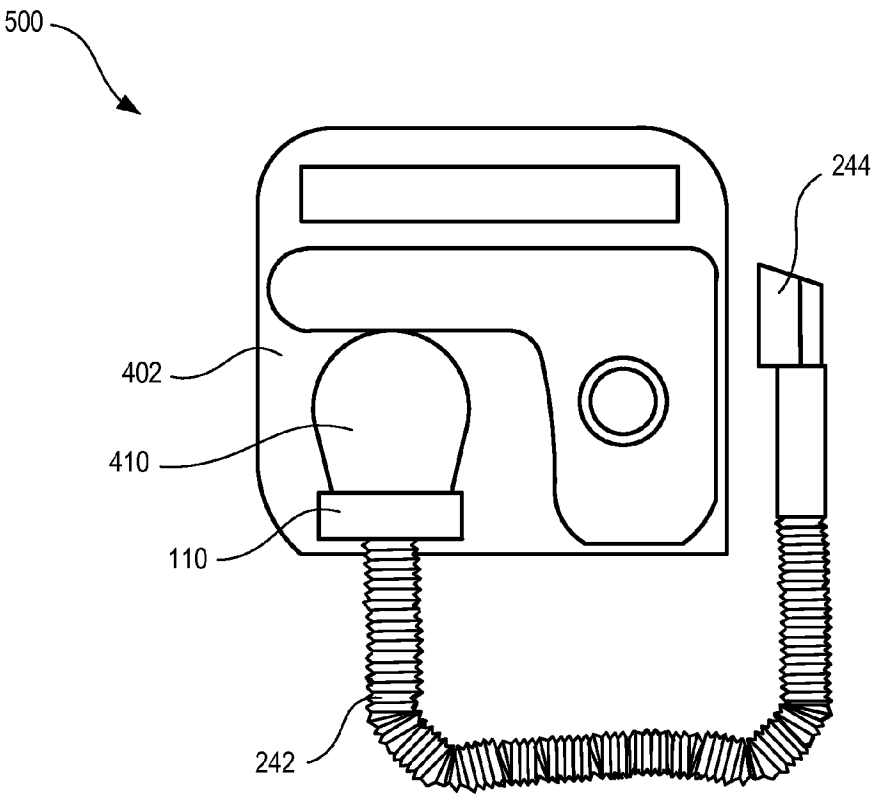

FIG. 4*c* illustrates a front view of an example forced air drying system; and FIG. 5 illustrates a front view of an example forced air drying system.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. Also, any reference to "attached," "fixed," "connected," "coupled" or the like may include permanent, removable, temporary, partial, full and/or any other possible attachment option.

For the sake of brevity, conventional techniques for wall-mounted hand dryer actuation may not be described in detail herein. Furthermore, the connecting lines shown in various figures contained herein are intended to represent exemplary functional relationships, electrical connections, and/or physical couplings between various elements. It should be noted that many alternative or additional functional relationships, electrical connections, or physical connections may be present in a practical air diversion devise or systems and methods for using the same.

Devices, systems, and methods described herein can increase drying efficacy of wall-mounted hand dryers for non-conventional users and non-conventional uses. By way of explanation, wall-mounted hand dryers are typically installed in restrooms and intended for the purposes of drying a user's hands after washing. Such hand dryers are frequently installed in public restrooms. Wall-mounted hand dryers are used by a wide array of individuals, including non-conventional users such as children and/or wheelchair users. Wall-mounted hand dryers are also used for a wide array of drying needs, including non-conventional needs such as drying of clothing and/or hair. Wall-mounted hand dryers typically comprise a single air output that is actuated by a button, lever, sensor, or the like.

Wall-mounted hand dryers are most effective when the air output is in close proximity to a target object, such as a user's hands. However, close proximity between the air output and the target object may not be possible for non-conventional users and/or for non-conventional uses. Accordingly, devices and systems for diverting air from the air output to the target object are desirable. Moreover, such devices may be retrofit on existing wall-mounted hand dryers to increase cost efficiency and decrease time and expense of modifications.

Diversion of air from the air output to the target object is addressed herein by providing an air diversion device configured to reroute air from an air output of a wall-mounted hand dryer to a first air outlet disposed distal from the air output. More specifically, in an example embodiment, a system for forced air drying comprises a wall-mounted hand dryer having a hand dryer output configured to expel, blow, or force air in an outward direction. The system further comprises an air diversion device. In an example embodiment, the air diversion device is configured to receive air from the hand dryer output.

FIG. 1 illustrates an example system for forced air drying. In accordance with an example embodiment, a system 100 for forced air drying comprises a wall-mounted hand dryer 102 and an air diversion device 104. Wall-mounted hand dryer 102 further comprises a hand dryer outlet configured to expel, blow, or force air in an outward direction and a manual actuator, such as a button, sensor, or the like. In the context of the present disclosure, devices, systems, and methods may find particular use in connection with wall-mounted hand dryers comprising a button actuator and a hand dryer outlet configured to direct forced air in a downward stream. However, various aspects of the disclosed embodiments may be adapted for optimized performance with a variety of wall-mounted hand dryers. As such, numerous applications of the present disclosure may be realized.

In an example embodiment, wall-mounted hand dryer 102 may be coupled to an air inlet 110 of air diversion device 104. In an example embodiment, air inlet 110 may be coupled to a hand dryer outlet of wall-mounted hand dryer 102 so as to create a fluid connection between wall-mounted hand dryer 102 and air diversion device 104.

Air diversion device 104 may further comprise an air rerouting component 120. Air rerouting component 120 may comprise a flap, valve, regulator, door, shutter, or the like. In an example embodiment, air rerouting component 120 comprises a sliding door. However, air rerouting component 120 may comprise a sliding door, rolling door, hinged door, or any other door or mechanism for switchably diverting communicated air. In an example embodiment, air rerouting component 120 is disposed between air inlet 110 and at least one of a first air outlet 140 and a second air outlet 160.

Air rerouting component 120 is configured to reroute air from air inlet 110 to at least one of first air outlet 140 and second air outlet 160. In an example embodiment, air diversion device 104 comprises first air outlet 140 and second air outlet 160. First air outlet 140 may be disposed on air diversion device 104. In an example embodiment, first air outlet 140 may be configured to receive air communicated from a wall-mounted hand dryer and expel, blow, or force air in an outward direction. Second air outlet 160 may be disposed on air diversion device 104. In an example embodiment, second air outlet 160 may be configured to receive air communicated from a wall mounted hand dryer and expel, blow, or force air in an outward direction.

In accordance with an example embodiment, air rerouting component 120 may be configured to switch between a first state a second state. The first state may comprise a fluid connection between air inlet 110 and first air outlet 140. The second state may comprise a fluid connection between air inlet 110 and second air outlet 160. Air rerouting component 120 may switch between the first state and the second state in response to a manual, mechanical, and/or electrical stimulus.

With reference to FIGS. 2*a* and 2*b*, in an example embodiment, air diversion device 104 comprises a cover 202. Cover 202 is adaptable to be coupled to a wall-mounted hand dryer. In an example embodiment, cover 202 may be configured to partially or fully surround a wall-mounted hand dryer. In an example embodiment, cover 202 comprises a substantially rectangular and/or prismatic shape. In such an embodiment, cover 202 may comprise at least one front face 206, at least one lateral face 204, at least one top face 205, and at least one bottom face 207. However, cover 202 may comprise any shape suitable to be coupled to a wall-mounted hand dryer. Cover 202 at least partially surrounds an inner volume 203. In an example embodiment, inner volume 203 is configured to receive air communicated from a wall-mounted hand dryer.

In an example embodiment, cover 202 defines a first aperture 210. First aperture 210 may surround and/or define air inlet 110. In an example embodiment, first aperture 210 is disposed in a top face 205 of cover 202. However, first aperture 210 may be disposed on any suitable portion of cover 202. In an example embodiment, first aperture 210 is elliptical in shape. In such an embodiment, first aperture 210 may comprise a shape and diameter substantially similar to a shape and diameter of a hand dryer output such that the hand dryer output may be snugly disposed in first aperture 210. However, first aperture 210 may be any shape and/or any size/diameter suitable for creating a fluid connection between the hand dryer output and inner volume 203 of cover 202.

In an example embodiment, first aperture 210 may comprise a seal 212 disposed on its perimeter. In an example embodiment, seal 212 comprises an elastomeric collar. However, seal 212 may comprise a ring, band, flange, lip, rim, or the like, and may comprise any material suitable for use in air diversion device 104. In an example embodiment, seal 212 is configured to create a substantially airtight connection between the hand dryer output and first aperture 210.

In an example embodiment, air diversion device 104 further comprises a wand 240 coupled to cover 202. Wand 240 may comprise a flexible tube 242. Flexible tube 242 comprises a first end and a second end, the first end being disposed at first air outlet 140 and the second end being disposed distal of the first end and first air outlet 140. Flexible tube 242 may be coupled to cover 202 such that flexible tube 242 is in fluid communication with inner volume 203 of air diversion device 104.

In an example embodiment, flexible tube 242 may comprise a length of about 0.3 meters to about 1 meter. However, flexible tube 242 may comprise any suitable length. In an example embodiment, the length of flexible tube 242 is expandable and retractable.

In an example embodiment, wand 240 may further comprise a nozzle portion 244 disposed on the second end of flexible tube 242. In an example embodiment, nozzle portion 244 is generally hollow and is in fluid communication with flexible tube 242. In an example embodiment and with additional reference to FIG. 3*b*, nozzle portion 244 may comprise a wand aperture 245 disposed distal to flexible tube 242 and cover 202. In such an embodiment, wand 240 is configured to communicate air from inner volume 203, through first air outlet 140, flexible tube 242, and nozzle portion 244, and to expel, blow, or force air through wand aperture 245 in an outward direction from air diversion device 104.

In an example embodiment, nozzle portion 244 may be rotatably coupled to wand 240 and/or to flexible tube 242. In such an embodiment, nozzle portion 244 may be configured to rotate about an axis parallel with a portion of flexible tube 242 near nozzle portion 244 and/or to rotate about a point at the second end of flexible tube 242.

In an example embodiment, and with momentary reference to FIG. 4*a*, nozzle portion 244 may further comprise an air velocity control mechanism 444. Air velocity control mechanism 444 may comprise a valve, cover, hatch, flap, slats, perforations, or the like, disposed on and/or in wand aperture 245. In an example embodiment, air velocity control mechanism 444 may comprise a plurality of apertures smaller in diameter than wand aperture 245. However, air velocity control mechanism 444 may comprise any suitable shape or configuration adapted to force air through an aperture smaller than wand aperture 245, thereby increasing the velocity of such forced air. In an example embodiment, air velocity control mechanism 444 may comprise one or more apertures of adjustable size. Moreover, air velocity control mechanism 444 may comprise an adjuster for adjusting the velocity and/or direction of the forced air exiting wand aperture 245.

In an example embodiment, and with momentary reference to FIG. 4*a*, wand 240 may further comprise a nozzle hook 246. In such an example embodiment, nozzle hook 246 is disposed on nozzle portion 244 and comprises a projection. In such an example embodiment, nozzle hook 246 comprises a shape complimentary to a shape of a nozzle hanger (discussed below. Nozzle hook 246 may be configured to hang or removably couple wand 240 to cover 202. In various embodiments, nozzle hook 246 may comprise a projection, depression, clasp, clip, clamp, peg, or the like.

In an example embodiment, cover 202 may define a second aperture 260. Second aperture 260 may surround and/or define second air outlet 160. In an example embodiment, second aperture 260 is disposed in a bottom face 207 of cover 202. However, second aperture 260 may be disposed on any suitable portion of cover 202. In an example embodiment, second aperture 260 is elliptical in shape. In such an embodiment, second aperture 260 may comprise a shape and diameter substantially similar to a shape and diameter of a hand dryer output such that a velocity of air expelled from second aperture 260 is similar to a velocity of air expelled from the hand dryer output. However, second aperture 260 may be any shape and/or any diameter suitable to expel, blow, or force air in an outward direction from air diversion device 104.

In an example embodiment, and with reference to FIGS. 2*a*, 2*b*, and 3*a*, air diversion device 104 may further comprise a nozzle hanger 250. In an example embodiment, nozzle hanger 250 may be disposed on a lateral face 204 of cover 202. However, nozzle hanger 250 may be disposed at any suitable location on cover 202. In an example embodiment, nozzle hanger 250 comprises a shape complimentary to a shape of nozzle hook 246. Nozzle hanger 250 may be configured to receive or removably couple wand 240 to cover 202. In various embodiments, nozzle hanger 250 may comprise a depression, projection, ledge, hook, peg, or the like.

In an example embodiment, air rerouting component 120 may be configured to bring air into fluid communication with at least one of wand aperture 245 and second aperture 260. In an example embodiment, air rerouting component 120 comprises a manually controlled mechanism for switchably diverting air from inner volume 203 to at least one of second aperture 260 and wand aperture 245. In an example embodiment, air rerouting component 120 comprises at least one manual shutter 222 coupled to second aperture 260. In an example embodiment, manual shutter 222 comprises one or more hinged flaps. However, in various embodiments, manual shutter 222 may comprise a cover, valve, flap, sliding door, rolling door, hinged door, or the like. In an example embodiment, manual shutter 222 may be configured to be opened and/or closed by a user. However, manual shutter 222 may comprise any configuration suitable to prevent substantial communication of air through second aperture 260, thereby rerouting air from the hand dryer outlet to wand 240 and through wand aperture 245.

In an example embodiment, air rerouting component 120 interacts with nozzle hanger 250 to switchably divert air from inner volume 203 to at least one of second aperture 260 and wand aperture 245. In such an embodiment, nozzle hanger 250 may be coupled to a mechanical shutter 224 of air rerouting component 120. In an example embodiment, mechanical shutter 224 comprises a sliding door. However, in various embodiments, mechanical shutter 224 may comprise a cover, valve, flap, rolling door, hinged door, or the like. In an example embodiment, mechanical shutter 224 may be configured to slide over second aperture 260. However, mechanical shutter 224 may comprise any configuration suitable to switchably prevent substantial communication of air through wand aperture 245 or through second aperture 260, thereby switchably rerouting air from the hand dryer outlet through at least one of second aperture 260 and wand aperture 245.

In such an example embodiment, in response to nozzle portion 244 being uncoupled from nozzle hanger 250, nozzle hanger 250 may comprise a first position. In an example embodiment, in response to the nozzle hanger 250 comprising the first position, air rerouting component 120 may comprise the first state, wherein mechanical shutter 224 is translated so as to bring air inlet 110 in fluid communication with first air outlet 140. Stated differently, when nozzle portion 244 is lifted off of nozzle hanger 250, air rerouting component 120 is configured to translate mechanical shutter 224 so as to divert air from a hand dryer outlet to wand 240 and through wand aperture 245.

In such an example embodiment, in response to nozzle portion 244 being coupled to nozzle hanger 250, nozzle hanger 250 may comprise a second position. In an example embodiment, in response to the nozzle hanger 250 comprising the second position, air rerouting component 120 may comprise the second state, wherein mechanical shutter 224 is translated so as to bring air inlet 110 in fluid communication with second air outlet 160. Stated differently, when nozzle portion 244 is hung on nozzle hanger 250, air rerouting component 120 is configured to translate mechanical shutter 224 so as to divert air from a hand dryer outlet to second air outlet 160 and through second aperture 260.

In an example embodiment, air diversion device 104 may further comprise an attachment mechanism 208. Attachment mechanism 208 may be configured to couple air diversion device 104 to a wall-mounted hand dryer. In an example embodiment, attachment mechanism 208 may be disposed on a lateral face 204 of cover 202. However, attachment mechanism 208 may be disposed on any suitable portion of air diversion device 104 or any suitable portion of cover 202 including, without limitation, a front face 206 of cover 202, a lateral face 204 of cover 202, a top face 205 of cover 202, or a bottom face 207 of cover 202. In an example embodiment, attachment mechanism 208 comprises rivets. However, attachment mechanism 208 may comprise rivets, bolts, welds, snaps, magnets, adhesive, and/or any other suitable mechanism for attaching air diversion device 104 to a wall mounted hand dryer. In various embodiments, air diversion device 104 may be permanently coupled to the wall-mounted hand dryer, or may be removably coupled to wall-mounted hand dryer.

With reference now to FIGS. 4*a* and 4*b*, a system 400 for forced air drying is provided. In an example embodiment, system 400 comprises a wall-mounted hand dryer 402 coupled to an air diversion device. In an example embodiment, the air diversion device comprises a cover 202 defining an inner volume and coupled to a hand dryer output 410 of wall mounted hand dryer 402. In an example embodiment, wall-mounted hand dryer may comprise a manual actuator 412. Air diversion device may further comprise wand 240 having a nozzle portion 244 configured to be received by and removably coupled to a nozzle hanger 250.

In an example embodiment, the air diversion device may be electrically coupled to wall-mounted hand dryer 402. In such an example embodiment, nozzle hanger 250 may be electrically coupled to a motor of wall-mounted hand dryer 402 and configured to cause a signal to be sent to the motor to turn on or otherwise electrically actuate wall-mounted hand dryer 402. In an example embodiment, in response to nozzle portion 244 being uncoupled from nozzle hanger 250, nozzle hanger 250 may comprise a first position. In such an example embodiment, in response to the nozzle hanger 250 comprising the first position, the air diversion device may actuate wall-mounted hand dryer 402, causing it to expel air through hand dryer output 410 for a duration of time. In such an example embodiment, in response to nozzle portion 244 being coupled to, and received by, nozzle hanger 250, nozzle hanger 250 may comprise a second position. In such an example embodiment, in response to the nozzle hanger 250 comprising a second position, the air diversion device may deactivate wall-mounted hand dryer 402.

With reference now to FIG. 4*c*, system 400 may comprise a cover 202 configured to at least partially surround wall-mounted hand dryer 402. In various embodiments, cover 202 may completely surround wall-mounted hand dryer 402. In various embodiments, wall-mounted hand dryer 402 may comprise an accessible portion and an inaccessible portion, wherein the inaccessible portion is substantially parallel and adjacent to a wall upon which wall-mounted hand dryer 402 is installed, and the accessible portion comprises the remainder of the wall-mounted hand dryer. In such an embodiment, cover 202 may surround all or substantially all of the accessible portion of wall-mounted hand dryer 402. In an example embodiment, cover 202 may be coupled to wall-mounted hand dryer 402 by a friction fit, rivets, bolts, welds, snaps, magnets, adhesive, and/or any other suitable mechanism for attaching cover 202 to wall mounted hand dryer 402. In an example embodiment, cover 202 may be configured to protect wall-mounted hand dryer 402 from damage. In an example embodiment, cover 202 may be configured such that a user cannot readily observe that wall-mounted hand dryer 202 has been retrofit with an air diversion device.

With reference now to FIG. 5, a system for forced air drying 500 is provided. In an example embodiment, system 500 may comprise a wall-mounted hand dryer 402 having a hand dryer output 410 disposed thereon, and an air diversion device coupled to hand dryer output 410. In such an example embodiment, the air diversion device may comprise an air inlet 110 and a nozzle portion 244 in fluid communication therewith. The air diversion device may be configured to receive air from wall-mounted hand dryer 402 and to expel, blow, or force air in an outward direction from nozzle portion 244. The air diversion device may further comprise a flexible tube 242 disposed between air inlet 110 and nozzle portion 244 so as to create a fluid connection therebetween. In an example embodiment, flexible tube 242 may be configured to extend and contract axially, thereby increasing or decreasing a length of flexible tube 242. In such an example embodiment, nozzle portion 244 may be screwed, snapped, or otherwise detachably coupled to air inlet 110. In such an example embodiment, nozzle portion 244 may be optionally detached from air inlet 110 and pulled distally from hand dryer outlet 410, thereby extending flexible tube 242.

In an example embodiment, a method for using a wall-mounted hand dryer may comprise identifying the wall-mounted hand dryer, selecting an air diversion device, and retrofitting the wall-mounted hand dryer. In various embodiments, the retrofitting may comprise coupling the air diversion device to at least one of the wall-mounted hand dryer and a hand dryer output, and attaching the air diversion device thereto. In various embodiments, the method may further comprise lifting a wand of the air diversion device, actuating the wall-mounted hand dryer, drying a target area, and returning the wand to the air diversion device. In various embodiments, the method may further comprise decoupling the air diversion device from the wall-mounted hand dryer.

While several illustrative applications have been described, many other applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts disclosed herein.

In describing the present invention, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also to include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

I claim:

1. A system for forced air drying comprising:

a wall-mounted hand dryer having a hand dryer output; and an air diversion device comprising:

an air inlet;

a first air outlet;

a second air outlet; and an air rerouting component for switching between a first state and a second state, wherein the first state consists of a first fluid connection between the air inlet and the first air outlet;

wherein the second state consists of a second fluid connection between the air inlet and the second air outlet;

wherein the air diversion device is attached to the wall-mounted hand dryer so as to receive air from the hand dryer output; and wherein the first air outlet is coupled to a wand.

2. The system of claim 1, wherein the wand further comprises a flexible tube and a nozzle portion, wherein the nozzle portion is disposed on a first end of the flexible tube and wherein a second end of the flexible tube is attached to the air diversion device at the first air outlet.

3. The system of claim 2, further comprising a nozzle hanger configured to receive the nozzle portion.

4. The system of claim 3, wherein the nozzle hanger is coupled to the air rerouting component and configured to switch between a first position and a second position, wherein the air rerouting component is in the first state in response to the nozzle hanger comprising the first position; and wherein the air rerouting component is in the second state in response to the nozzle hanger comprising the second position.

5. The system of claim 4, further comprising at least one attachment mechanism configured to removably couple the air diversion device to the wall-mounted hand dryer.

* * * * *